US006923440B2

(12) United States Patent
Cherry

(10) Patent No.: US 6,923,440 B2
(45) Date of Patent: Aug. 2, 2005

(54) SEAL CARD GAME WITH RAFFLE

(75) Inventor: David J. Cherry, Florence, KY (US)

(73) Assignee: Arrow International, Inc., Cleveland, OH (US)

( * ) Notice: Subject to any disclaimer, the term of this patent is extended or adjusted under 35 U.S.C. 154(b) by 95 days.

(21) Appl. No.: 10/729,175

(22) Filed: Dec. 5, 2003

(65) Prior Publication Data

US 2004/0173962 A1 Sep. 9, 2004

Related U.S. Application Data

(60) Provisional application No. 60/451,750, filed on Mar. 4, 2003.

(51) Int. Cl.[7] ..... A63F 3/06

(52) U.S. Cl. ..... 273/139; 273/138.1; 273/269; 283/901; 283/903

(58) Field of Search ..... 273/139, 138.1, 273/269; 283/901, 903

(56) References Cited

U.S. PATENT DOCUMENTS 4,943,090 A * 7/1990 Fienberg ..... 273/139
5,046,737 A 9/1991 Fienberg
5,092,598 A * 3/1992 Kamille ..... 273/139
5,158,293 A * 10/1992 Mullins ..... 273/139
5,217,258 A * 6/1993 Sanderson ..... 283/105
5,407,199 A * 4/1995 Gumina ..... 273/139
5,407,200 A 4/1995 Zalabak
5,451,052 A * 9/1995 Behm et al. ..... 273/139
5,494,317 A * 2/1996 Johnson ..... 283/72
5,562,284 A * 10/1996 Stevens ..... 273/139
5,647,592 A * 7/1997 Gerow ..... 273/139
5,657,991 A * 8/1997 Camarato ..... 283/901
5,671,921 A 9/1997 Quinlan
5,743,524 A 4/1998 Nannicola
5,788,237 A 8/1998 Fults et al.
5,931,468 A 8/1999 Orolin
5,934,671 A * 8/1999 Harrison ..... 273/139
6,145,885 A * 11/2000 Scrymgeour et al. ..... 283/94
6,224,055 B1 * 5/2001 Walker et al. ..... 273/139
6,305,687 B1 10/2001 Pollock et al.
6,309,298 B1 * 10/2001 Gerow ..... 463/20
6,347,794 B2 * 2/2002 Scrymgeour et al. .... 273/138.1
6,390,916 B1 * 5/2002 Brown ..... 463/17
6,435,500 B2 * 8/2002 Gumina ..... 273/139
6,543,808 B1 * 4/2003 Mitchell et al. ..... 283/49
6,612,576 B1 9/2003 Stancik et al.

(Continued)

FOREIGN PATENT DOCUMENTS

EP 1184058 A1 * 3/2002 ..... A63F/3/06
GB 2318985 A * 5/1998 ..... A63F/3/06
JP 2003330397 A * 11/2003 ..... A63F/3/06

OTHER PUBLICATIONS

U.S. Appl. No. 60/309,927.

*Primary Examiner*—Derris H. Banks
*Assistant Examiner*—Urszula M. Cegielnik
(74) *Attorney, Agent, or Firm*—Fay, Sharpe, Fagan, Minnich & McKee, LLP

(57) ABSTRACT

A system for use in playing a game of chance includes a plurality of playing cards (10, 10', 10", 10'"). Optionally, at least some of the plurality of playing cards display a free ticket symbol (40) which entitles a holder of the playing card to receive at least one free ticket (12). A plurality of the free tickets is also included. Each of the free tickets displays at least one game symbol (30). At least some of the playing cards and at least some of the free tickets include at least one eligible game symbol displayed thereon (82, 110), selected from said game symbols. A master game card (14, 214, 216, 314, 414) is also included for use in conjunction with the playing cards and free tickets. The master game card includes means for identifying at least one of said eligible game symbols as a winning game symbol (112, 230).

33 Claims, 10 Drawing Sheets

U.S. PATENT DOCUMENTS 6,659,458 B1 * 12/2003 Peters et al. ..... 273/138.1
6,714,838 B2 * 3/2004 Scrymgeour et al. ..... 700/242
2001/0002079 A1 * 5/2001 Scrymgeour et al. .... 273/138.1
2001/0040341 A1 * 11/2001 Kamille ..... 273/138.1
2002/0072404 A1 * 6/2002 Gerow ..... 273/139
2002/0084584 A1 * 7/2002 Yusuf ..... 273/138.1
2002/0093188 A1 * 7/2002 Downes et al. ..... 283/903
2003/0030211 A1 * 2/2003 Brown ..... 273/139
2003/0067109 A1 * 4/2003 Such ..... 273/138.1
2003/0116916 A1 6/2003 Cherry
2003/0132576 A1 7/2003 Stancik

* cited by examiner

SEAL CARD GAME WITH RAFFLE

This application claims the priority of U.S. Provisional Application Ser. No. 60/451,750, filed Mar. 4, 2003, the specification of which is incorporated herein in its entirety, by reference.

BACKGROUND OF THE INVENTION

The present invention relates to gaming systems and, more particularly, to a lottery-type gaming system.

Lottery-type games of chance have exhibited enduring popularity since such games typically permit a player to make a relatively small investment—by buying a ticket—with a chance of winning a significantly larger award. In addition to the entertainment value that such games provide for the players, these types of games typically provide a source of revenue for the operator, normally a charity, but sometimes a municipality or a business establishment.

One type of game system which has proven quite popular with players is the so-called break-open ticket game. In this type of game, players purchase playing cards for a relatively nominal sum, with each playing card displaying game symbols, selected ones of which correspond to award values. In a typical configuration, each playing card comprises a lamination of upper and lower plies of material, such as paper, with the game symbols displayed on the inside surface of the lower ply. The game symbols are thus initially sealed, and are revealed by "breaking open" one or more flap-like portions of the upper ply.

As will be appreciated, affording players an opportunity to win awards in different ways enhances the entertainment value of the game. It has, therefore, been considered desirable to develop a new and improved seal card game and method for playing same which would meet the above stated needs and others and provide advantageous overall results.

SUMMARY OF THE INVENTION

In accordance with one aspect of the invention, a system for use in playing a game of chance is provided. The system includes a plurality of playing cards, at least some of said plurality of playing cards displaying a free ticket symbol which entitles a holder of the playing card to receive at least one free ticket. The system also includes a plurality of free tickets. Each of the free tickets displays at least one game symbol thereon. At least some of the playing cards and at least some of the free tickets include at least one eligible game symbol displayed thereon. The system further includes a master game card for use in conjunction with the playing cards and free tickets. The master game card includes means for identifying at least one of said eligible game symbols as a winning game symbol.

In accordance with another aspect of the invention, a system for playing a game of chance is provided. The system includes a plurality of playing cards. At least some of the playing cards include at least one of a plurality of eligible game symbol displayed thereon. A raffle board is provided for use in conjunction with the playing cards. The raffle board includes means for identifying at least one of a first plurality of the eligible game symbols as a winning raffle game symbol. The means for identifying includes a first plurality of cover members. Each of the first plurality of cover members selectively covers a first portion of a raffle game symbol. The means for identifying also includes second plurality of cover members. Each of the second plurality of cover members selectively covers a second portion of a raffle game symbol, whereby by uncovering a selected one of the first plurality of cover members and a selected one of the second plurality of cover members, first and second portions of the winning raffle game symbol are revealed.

In accordance with another aspect of the invention, a method of playing a game of chance is provided. The method includes distributing a set of playing cards to a plurality of players, removing at least one cover member on each of the playing cards to reveal at least one of a plurality of game symbols. At least some of the plurality of playing cards includes a free ticket symbol, which entitles a holder of the playing card to receive at least one free ticket. The method further includes distributing the free tickets to the holders of playing cards displaying the free ticket symbols and removing at least one cover member from the free tickets. At least one of the playing cards and the free tickets includes an eligible first type of game symbol of the plurality of game symbols which is eligible for a first bonus round of play. At least one of the playing cards and free tickets includes an eligible second type of game symbol of the plurality of game symbols, which is eligible for a second bonus round of play. The method further includes playing the first bonus round of play and playing the second bonus round of play.

In accordance with another aspect of the invention, a method of playing a game of chance is provided. The method includes distributing a set of playing cards to a plurality of players and removing at least one cover member on each of the playing cards to reveal at least one of a plurality of game symbols. At least some of the plurality of playing cards includes a free ticket symbol, which entitles a holder of the playing card to receive at least one free ticket. The method further includes distributing the free tickets to the holders of playing cards displaying the free ticket symbols and removing at least one cover member from the free tickets. At least one of the playing cards and the free tickets includes an eligible first type of game symbol of said plurality of game symbols which is eligible for a bonus round of play; the eligible first type of game symbols including a plurality of characters. The method further includes playing the bonus round of play, including opening a cover member on a master game card to reveal one of the plurality of characters in a winning game symbol selected from the second type of eligible game symbols and) repeating this step for each of the plurality of characters in the winning game symbol.

In accordance with another aspect of the invention, a method of playing a game of chance is provided. The method includes distributing a set of playing cards to a plurality of players, removing at least one cover member on each of the playing cards to reveal at least one of a plurality of game symbols. A plurality of the playing cards include a raffle game symbol of said plurality of game symbols which is eligible for a bonus round of play comprising a raffle. In the bonus round of play, the method includes revealing a first portion of a winning raffle game symbol on a first area of a master game card and revealing a second portion of the winning raffle game symbol on a second area of the master game card.

The advantages of the present invention will become apparent to those skilled in the art upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
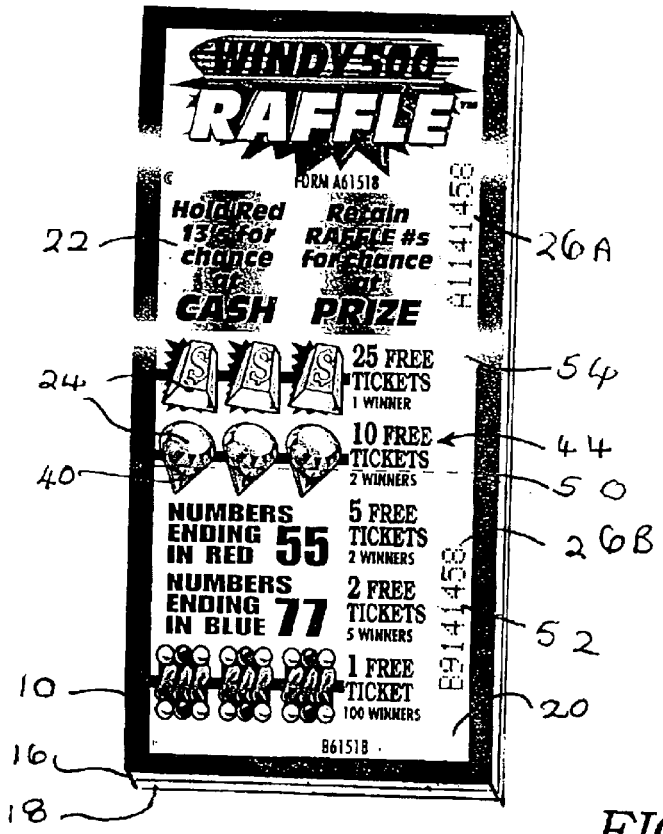
FIG. 1 is a top perspective view of a front face of a playing card for a multiple level game system according to the present invention.

While this invention is susceptible of embodiment in many different forms, there is shown in the drawings and will herein be described in detail, a preferred embodiment of the invention. However, it should be understood that the Figures are to be considered only as exemplifying the principles of the invention and are not intended to limit the invention to the embodiment illustrated.

Figure 3:
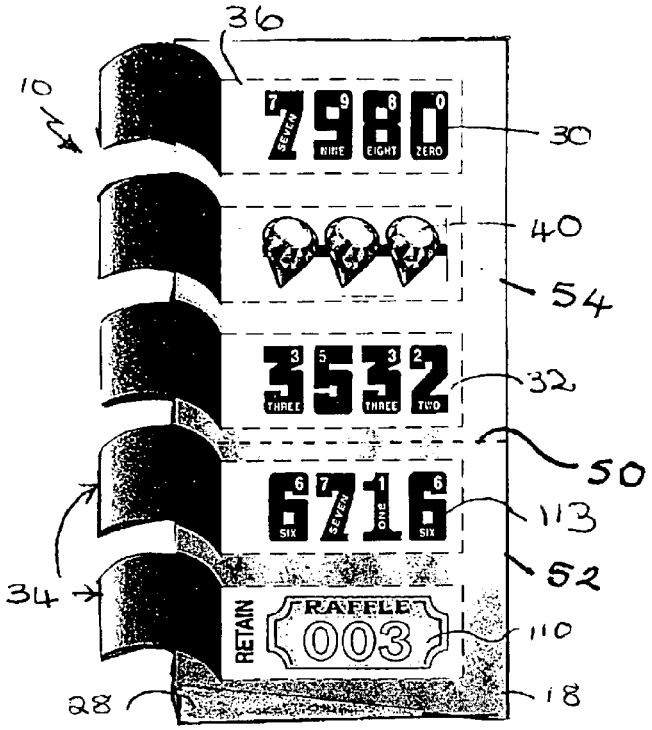
FIG. 3 is a perspective view of the rear face of the playing card of FIG. 2 with five flaps opened.
Figure 4:
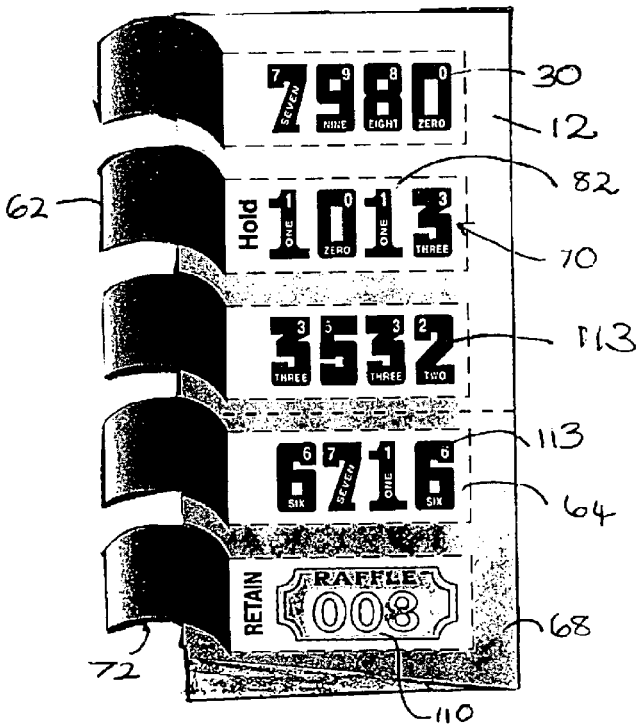
FIG. 4 is a perspective view of the rear face of a free ticket.
Figure 5:
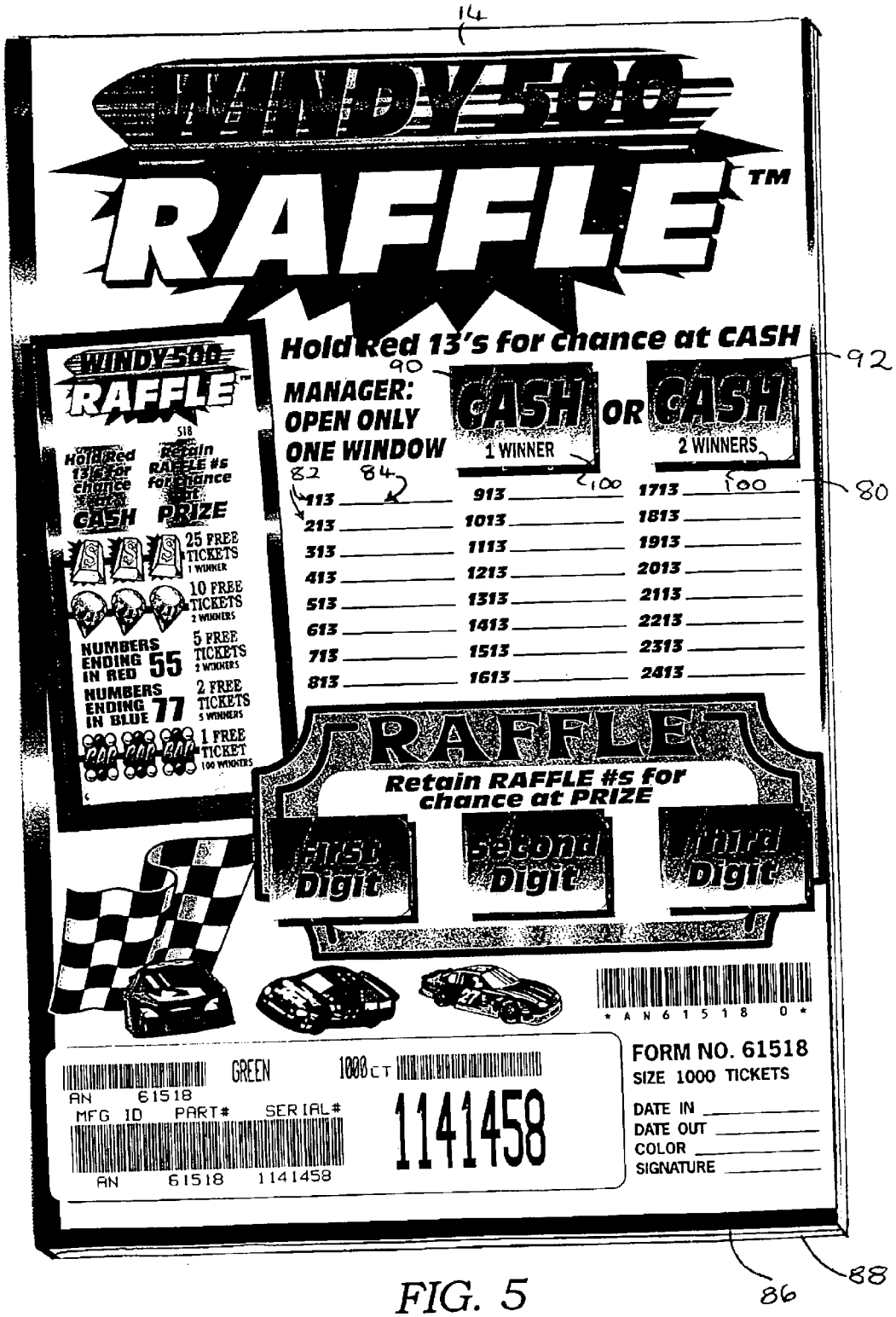
FIG. 5 is a top perspective view of a master game card of the game system according to the present invention.
Figure 6:
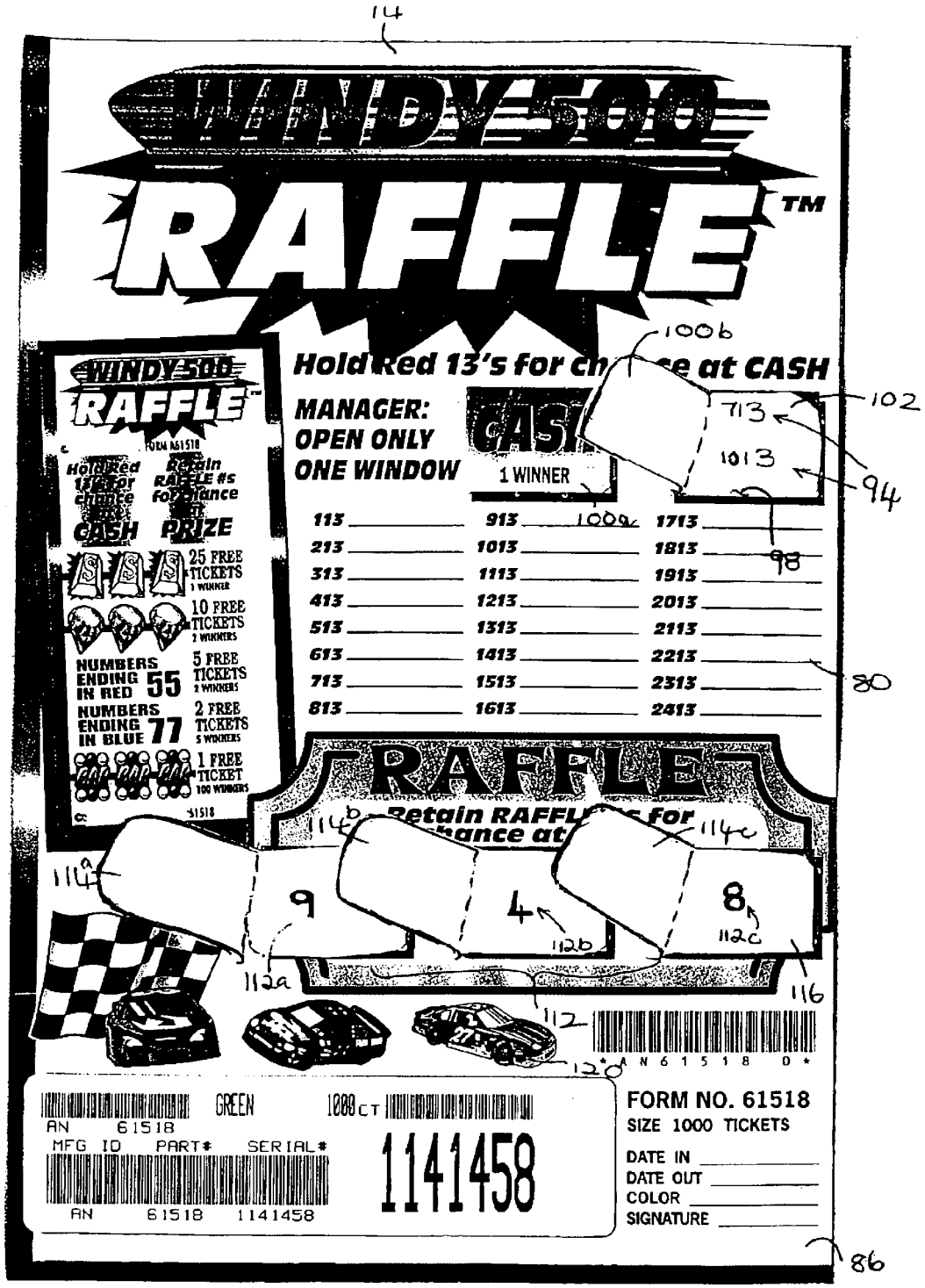
FIG. 6 is a top plan view of the master game card of FIG. 5 with the flaps open to reveal the winning symbols.

FIGS. 1–4 illustrate playing cards 10 and additional or "free" playing cards or tickets 12 (which will be referred to herein as free tickets) and FIGS. 5 and 6 illustrate a master game card 14 for use in conjunction with the playing cards and tickets. The playing cards 10, free tickets 12, and master game card 14 are used in combination for playing a game of chance, namely a two or more level game system according to the present invention. Certain ones of the players are eligible to participate in the selection of a bonus award on the master game card 14. While the game is described with reference to a first level of play followed by two bonus rounds of play, it will be appreciated that the first level may be modified and additional bonus rounds may be used, for example, three, four, or more bonus levels of play.

Playing card 10 is intended as exemplary, in that the present game system includes a substantial number of such playing cards. In a preferred embodiment, for example, about 500 to about 1,000 cards are employed. Each of the playing cards 10 is purchased by a game player for a nominal sum, such as $1, which may be printed on the playing card. The playing card price may be printed on the card 10, although it is also contemplated that a game organizer may be free to set the playing card price and thus determine the total profit accordingly. Free tickets 12 are similar to playing cards 10, except as described herein. The free tickets 12 are awarded as prizes to certain holders of the playing cards 10, as will be described in detail below. For example, there may be 1000 cards and tickets 10, 12 in total, with about 165 of these being free tickets 12.

A fixed number of the playing cards 10 and free tickets 12 can be packaged as a set or deal, in a clear wrapping (not shown), together with the master game card 14. By having a fixed number of cards 10 and tickets 12 in the set of playing cards and free tickets, the total organizer, knowing what sum it wishes to charge for each card 10, can readily calculate the total payout and the profit. Optionally, the sets of free tickets 12 and playing cards 10 are assembled such that the total payout is fixed and is the same for each deal.

As shown in FIG. 1, each of the playing cards 10 and tickets 12 can comprise upper and lower layers or plies 16 and 18 of material, laminated together at the edges of their inner surfaces, and formed from paper, cardstock, or the like. An outer, first face 20 of one of the plies 16 may be used to display information about the game, such as the rules 22 of the game, examples of winning combinations 24 of symbols, information about the free tickets 12, and the like (see FIG. 1). Optionally, the price of each playing card 10 is also printed on the first face 20 or elsewhere on the playing card 10, although in the illustrated embodiment, no price is set, leaving the game organizer free to set the price. An identifying character 26A, 26B, such as a serial number, is optionally printed on the front face 20 or a rear face 28 (FIG. 2) of the card 10 for identifying the playing card 10 as being part of the set of playing cards, all with the same serial number and associated with a corresponding serial number printed on the master game card 14. This avoids the instance of a player from a previous game trying to collect an award in a subsequent game using the same card 10 or ticket 12.

Figure 2:
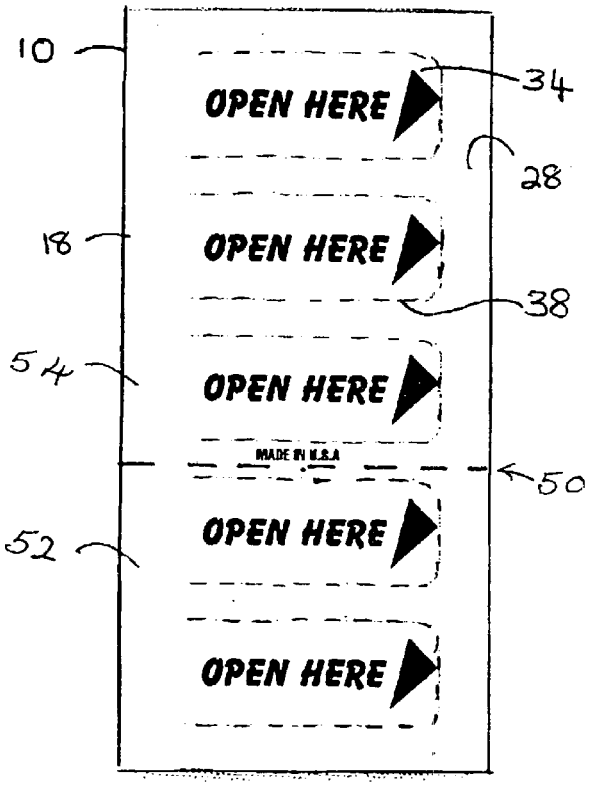
FIG. 2 is a top plan view of a rear face of the playing card of FIG. 1.

With particular reference to FIG. 3, each of the playing cards 10 and tickets 12 displays at least one, and generally, a plurality of game symbols 30. The symbols 30 may be letters, numbers, and/or characters, such as fruit, diamonds, dollar signs, crowns, bells, and the like commonly associated with lottery games, which may be arranged singly, or in groups. Each of the cards 10 includes a plurality of flaps or cover members, a single cover member, or other game symbol concealing means, such as a scratch-off layer. The symbols 30 can be displayed on an inside surface 32 of the upper ply 16 of the playing card. This type of playing card 10 is typically referred to as a "break-open" playing card, in that the cover member comprises one or more flap-like portions 34 of the lower ply 18 (five flaps 34 for each card 10 are shown in FIGS. 2–4) which each cover one or more game symbols 30.

The flaps 34 can be selectively opened (e.g., peeled away from the card 10) in order to reveal windows 36 each displaying one or more game symbols 30 beneath, after the card has been purchased (FIG. 3). The flaps 34 have perforated edges 38 (FIG. 2), allowing them to be readily separated from the surrounding lower ply material.

In its first level of play, the game can have a plurality of the game symbols 30 which constitute free ticket award symbols 40, such as three diamonds shown in the playing card 10 of FIG. 3. Generally, fewer than all of the playing cards will display free ticket award symbols 40. To assist players in ascertaining winning cards at the first level of play, a listing 24 of the winning groups of free ticket award symbols 40 is provided on the front face 26 of each playing card and/or on the master game card. The present game system provides additional tickets, in the form of free tickets 12 to those players having cards 10 which display a predetermined free ticket award symbol or combination of free ticket award symbols 40.

Different symbols or groups of symbols 40 may be used to identify different numbers of free tickets. In the embodiment shown in FIG. 1, by way of example, a winning group of award symbols 40 comprising three diamonds entitles the playing card holder to receive an award 44 of a preselected number of tickets 12, ten free tickets 12 in the illustrated embodiment. Three gold bars entitles the holder to twenty-five free tickets, while a group of numbers ending in a red "55" entitles the holder to receive five free tickets 12, and so forth. The playing card holder compares the symbol or groups of symbols 30 under each flap 34 with the different groups of free ticket award symbols on the listing 24 to determine whether the playing card 10 is a free ticket-winning playing card.

As can be seen from FIG. 1, the number of free ticket award winners corresponding to each different winning group of award symbols 40 is shown on the listing 24. For example, five winners having a group of numbers ending in a blue "77" receive two tickets 12. For some awards 44, there may be only one winner, as is the case with the three gold bars illustrated.

Although in the illustrated embodiment, all of the awards 44 are in the form of free tickets 12, having no immediate value, it is also contemplated that some of the awards 44 could be in the form of prizes having an ascertainable value, such as money or merchandise.

A holder of a playing card 10 displaying a winning group of award symbols 40 takes the winning playing card 10 to a game organizer and receives the number of free tickets 12 associated with the particular winning symbol or group of symbols 40 (FIG. 1). Each playing card and free ticket includes a perforation 50, which allows a lower portion 52 to be separated from an upper portion 54 of the playing card. The ticket/card holder hands the portion 54 (in the illustrated embodiment, the upper portion) displaying the free ticket award symbol 40 to the game organizer in return for the award of free tickets. If other awards of an "instant win" type are made, these can be printed on the same portion 54 of the playing card 10 as the free ticket award symbol, or on a portion or portions which are detachable from other portions. The remaining, lower portion 52 is retained until later, as will be described below. Both lower and upper portions 52, 54 of each playing card 10 are identified with a serial number 26A, 26B, respectively, which corresponds to the serial number marked on the master game card 14. The serial numbers may differ by one or more characters (A and B in the illustrated embodiment), to designate the portion 52, 54 of the card.

Alternatively, the game organizer may mark the card 10 to show that the tickets 12 have been awarded, since the winning card 10 may be eligible for further rounds of play, as will be described herein.

As illustrated in FIG. 4, each of the free tickets 12 in the set is similar to playing card 10 in that game symbols 30 are covered with cover members 62. However, in one embodiment, the free tickets do not include any of the winning symbols 40 which entitle the holder to receive additional free tickets. Nor is there any price marked on the tickets 12.

The free tickets 12 can be marked with a serial number (not shown), similar to that shown in FIG. 1, which corresponds to the serial number marked on the master game card 14 and playing cards 10. Each of the free tickets 12 includes a plurality of cover members 62, or other game symbol concealing means. The symbols 30 can be displayed on an inside surface 64 of an upper ply of the card, as with the playing cards 10. The free ticket 12 can thus be a "break-open" playing card, in that the cover members 62 comprise flap-like portions of a lower ply 68. Each flap 62 covers one or more game symbols 30. The flap 62 can be selectively opened (e.g., peeled away as shown in FIG. 4) from the ticket 12 in order to reveal a window 70 displaying the respective one or group of game symbols 30 beneath, after the free tickets have been distributed. The flap 62 has a perforated edge 72 allowing it to be readily separated from the surrounding lower ply material.

However, it will be understood that a game embodying the principles of the present invention may include playing cards, free tickets, and a master game card otherwise configured, such as including "scratch-off" arrangements for initially concealing game symbols or groups of game symbols.

In its additional, bonus level(s) of play, the present system permits selected ones of the players to become eligible for one or more bonus awards through use of the master game card 14.

One bonus level of play of the present game system entails establishing selected game players who become eligible for one or more bonus awards, with these players then listed on the master game card 14 in the illustrated embodiment. To this end, the master game card 14 includes a sign up area 80 (FIG. 5), for listing the selected, eligible players. The eligibility of these selected players is established by those players having playing cards 10 and/or free tickets 12 having a predetermined selected one or more of the game symbols 82. In the illustrated embodiment, such predetermined eligible game symbols 82 comprise numeric designations ending in a red 13 (i.e., 113, 213, 313, etc.). FIG. 4 exemplifies a free ticket 12 which reveals the eligible symbol 1013 under one of the flaps 62. Of course, other characters or indicia could alternatively be used in place of numerals ending in 13. Each of the eligible game symbols 82 is printed on one of the game playing cards 10 or free tickets 12. In the illustrated embodiment, eligible game symbols 82 are present on both playing cards 10 and free tickets 12, although it is also contemplated that the eligible game symbols 82 could be associated with one but not the other of the playing cards and free tickets.

In the case of playing cards 10, the eligible game symbol 82 can be located on the same portion 54 of the card/ticket as is used for the free ticket symbols. In one embodiment, a playing card can have a game symbol 40 or a game symbol 82, but not both.

Upon opening a flap 34,62 to reveal an eligible game symbol or group of eligible game symbols 82 (both will be referred to hereinafter simply as eligible game symbols), the game player can enter his name on the sign up area 80 in the appropriate location (e.g., adjacent his eligible symbol 82). In the embodiment of FIG. 5, for example, twenty-four eligible game symbols 82, all ending in the numerals "13", are contained within sign-up area 80 and are thus identified as being eligible game symbols 82.

Associated with each eligible game symbol 82 of sign-up area 80 is a name region 84. Each name region 84 provides space for the recordation of the name, or other indicia, identifying the holder of a playing card 10 or ticket 12 which displays the associated eligible game symbol 82. As shown in FIG. 5, the master game card 14 can comprise a lamination of upper and lower plies of material 86 and 88. The master game card 14 further includes an arrangement whereby a selected one (or more than one) of the listed, eligible players is identified as a winner in the first bonus round (or in more than one bonus rounds) of play.

The master game card 14 is shown in FIGS. 5 and 6 as including a first bonus playing round associated with the first type of listed eligible game symbols 82 and a second bonus round, described herein as the raffle round, associated with a second type of eligible game symbols, which will be described in greater detail below. It will be appreciated, however, that more than two such bonus rounds may be included. In the illustrated embodiment, the master game card 14 includes at least one award identifier 90, which is associated with the first bonus round (FIG. 5). In the illustrated embodiment, two award identifiers 90, 92 are provided. The first award identifier 90 indicates that a cash prize is to be awarded to one of the eligible players, while the second award identifier 92 indicates that a cash prize is to be awarded to two of the eligible players. Optionally, as illustrated, the award identifiers 90, 92 do not specify the amount of the cash award, giving the game organizer the opportunity to set the amount and thus determine the total payout. For example, the organizer may announce, prior to selling the cards 10 for the game, that the total award for the first bonus round will be $500, or any other selected amount.

At least one winning game symbol 94 selected from the eligible game symbols 82 is associated with each award (FIG. 6). In the illustrated embodiment, the winning game symbol(s) 94 are printed on an upper surface 98 of the lower ply 88 (FIG. 5). The winning game symbol 94 is covered by a cover member 100*a*, 100*b* such as a perforated flap similar to those on the playing cards 10, or other cover member, such as a scratch-off portion. The flap 100 is formed in the top ply 86 of the master game card and is pulled away to reveal a window 102 displaying the winning game symbol or symbols 94. The holder(s) of the playing card 10 or ticket 12 with the winning symbol(s) 94 collects the award from the organizer.

In the illustrated embodiment, the game organizer is given the choice of opening one of two spaced flaps 100*a* and 100*b*. The first flap 100*a* is associated with a single winning game symbol 94. Thus, there is one winner if this flap is opened. The second flap is associated with two winning game symbols 94, i.e., two of the first type of eligible symbols 82 are winners. The organizer may announce, prior to selling the playing cards, which of the two flaps 100*a*, 100*b* will be opened. Or, the game organizer may wait until the sign-up area 80 is completed before announcing which flap will be opened. While the organizer generally provides the same total award, irrespective of which flap is opened (i.e., if there are two winners each receives half of the total award), it is also contemplated that differing total awards may be made depending on which flap 100*a*, 100*b* is opened, at the discretion of the organizer.

Although the winning game symbol or symbols 94 under the flaps are predetermined, the symbols are printed and covered with flaps prior to distribution to the game organizer. The game organizer and players do not know what the symbol or symbols are until the flap 100*a*, 100*b* is open. Thus for the intents and purposes of the game, the selection of game symbols 94 is essentially random and cannot be influenced by the players or the organizer. The only control the game organizer has is the choice of opening a window which will show one or two of the symbols 82 as being winners.

In an alternate embodiment, the award identifier 90,92 identifies a specific award or awards, such as a monetary amount. In this case, the award, such as a monetary amount, is printed on a top surface of the flap 100, or elsewhere on the master game card 14 or on playing cards 10.

If more than one winning game symbol 94 is used, there may be two or more winning symbols revealed, either by opening a single flap 100*b*, or by opening more than one flap. For example, the game could be changed to have multiple flaps, all of which are opened by the game organizer. In such an embodiment, a first flap may be opened to reveal the winning game symbol(s) corresponding to a $50 award, a second flap, the winner of a $150 award, and a third flap, the winner of a $399 award, as an example.

The holder of a winning playing card or ticket 10,12 (i.e., a card or ticket displaying a winning game symbol 94) receives the predetermined award associated with the winning game symbol 94 present on that playing card or ticket, or which is associated with the particular winning game symbol 94, where more than two awards are associated with the bonus round. For example, in the embodiment of FIG. 4, the ticket 12 showing the winning symbol 94 having the numeric designation "1013" is one of the two bonus round winners in the first bonus round. The holder of the playing card displaying winning game symbol "1013" thus receives the award set by the game organizer.

Initially, the flaps 100 on the master game card are in a closed position, covering the associated winning game symbol 94 (or symbols), as shown in FIG. 5. The playing cards 10 are distributed and the players provided with time to open their flaps 34 and collect any free tickets 12 and open their flaps 62. The players holding eligible symbols on the cards or tickets enter their names on the sign-up area 80. Then, the flap 100*a* or 100*b* on the master game card 14 selected by the game organizer is opened in order to reveal the winning game symbol or symbols 94.

Although, in the illustrated embodiment, winning game symbol concealment is achieved through the use of a 2-ply master game card construction, the winning game symbol cover member 100 or members may have numerous alternative configurations. For example, master game card 14 may comprise only a single ply construction, with the winning game symbol cover member 100 comprising a flap-like member affixed to master game card 14 along one or more sides of the flap-like member. Alternatively, the winning game symbol cover member 100 may comprise a removable opaque substance, such as conventionally known "scratch-off" material.

The second bonus round of play, the raffle round, can be played after the first round has been completed. However, it is also contemplated that the second round may be carried out prior to or contemporaneously with the first bonus round. It is also contemplated that the first round may be eliminated altogether and play proceed immediately to the raffle round after distribution of the playing cards and tickets.

The raffle round entails establishing a selected game player or players who receives or becomes eligible for a raffle prize. Prior to the start of the raffle round, preferably before the playing cards 10 are sold, the game organizer announces the raffle prize. For example, the raffle prize may be a monetary award, merchandise, or a chance to enter a further raffle for a "grand prize" in which players from other games are also eligible to participate. The eligibility of the selected players for the raffle prize is established by those players having playing cards 10 and/or free tickets 12 having a predetermined selected one or more eligible game symbols or eligible raffle symbols 110 of the game symbols 30. In the illustrated embodiment, every playing card 10 and free ticket 12 includes a raffle symbol 110 (FIG. 4), such that all holders are eligible for the raffle prize. The raffle symbols can comprise numeric designations from 000 to 999 (i.e., a total of 1000 cards and tickets), combinations of letters and numbers, or the like. Thus each ticket/card of the set can be eligible for the second bonus round or raffle. Alternatively, certain of the tickets/cards could have two or more symbols 110, while other tickets/cards have none. The raffle symbol may be printed on a separate portion 52 of the playing card 10 or ticket 12 from that of the "free ticket" award symbol 40 and/or game symbol 82, such that the portion 52 can be held by the holder until the raffle is drawn. This avoids the need for the ticket/card holders to sign up in a sign up area on the master game card, adjacent the associated raffle symbol. In the illustrated embodiment, the raffle symbol 110 is always located in the fifth (bottom) window on the ticket or playing card, so that it can be readily identified. The serial number 26B (FIG. 1) printed on the portion 52 displaying the raffle symbol 110 can be used as an identifier by the game organizer to ensure that the portion 52 is only used for participation in the raffle associated with the corresponding set of tickets/cards and master game card.

FIG. 3 exemplifies a playing card 10, which reveals the raffle symbol "003" under one of the flaps 34. Other characters could alternatively be used in place of numerals. Each of the raffle symbols 110 is printed on one of the game playing cards 10 or free tickets 12. In the illustrated embodiment, raffle symbols 110 are present on both playing cards 10 and free tickets 12, although it is also contemplated that the eligible raffle symbols 110 could be associated with one but not the other of the playing cards and free tickets.

The remainder of the playing cards 10 and free tickets 12 and other windows of the winning playing cards and tickets display "non-winning" symbols 113. For example, non-winning symbols may comprise numbers, as illustrated on the ticket 12 of FIG. 4. Alternatively, the non-winning tickets 12 and windows may be left blank or otherwise marked as a non-winner.

In one embodiment, the master game card 14 further includes an arrangement whereby a selected one (or more than one) of the players is identified as a winner in the raffle round, i.e., the second bonus round of play.

The master game card 14 is shown in FIG. 6 as including at least one winning raffle game symbol 112, selected from the raffle symbols 110, which is associated with the raffle prize. In the illustrated embodiment, the winning game symbol(s) 112 are printed on the upper surface 98 of the lower ply 88 (FIG. 5). The winning raffle game symbol 112*a*, 112*b*, 112*c* is covered by at least one cover member 114, such as a perforated flap similar to those on the playing cards 10, or other cover member, such as a scratch-off portion. Each flap 114 is formed in the top ply 86 of the master game card and is pulled away to reveal a window 116 displaying the winning game symbol or symbols 112, or a portion thereof. In the illustrated embodiment, a plurality of flaps 114*a,b,c* each cover a portion 112*a,b,c* of the winning symbol 112. For example, each raffle symbol 110 includes three (or more) characters, such as digits. A first flap 114*a* covers a window displaying the first digit 112*a* (the number "9" in the illustrated embodiment) of the winning symbol 112, a second flap 114*b* covers the second digit 112*b* (the number "4"), and a third flap 114*c* covers the third and any final digit 112*c* (the number "8"). The game organizer can open the flaps 114*a,b,c* in turn, e.g., sequentially. This adds to the excitement of the raffle, as each flap opened eliminates more of the eligible raffle symbols 110.

In the illustrated embodiment, all of the raffle numbers 110 have exactly three digits (zero, as well as 1–9, being considered digits). Thus, each one of the winning digits 112*a*, 112*b*, and 112*c* is covered by an individual flap. This allows all of the non-raffle numbers 82, 113 printed on the card to be four (or more) digit numbers. Additionally, the raffle numbers 110 may be identified as being specifically for use with the raffle, e.g., with the word RAFFLE printed adjacent the number.

The holder(s) of the playing card 10 or ticket 12 with the winning raffle game symbol 112 collects the raffle prize from the organizer, which as indicated earlier, may be a prize of ascertainable value, such as cash or merchandise, or a prize of indeterminate value, such as a chance of winning a grand prize. In the latter case, the organizer may provide the winner with a raffle ticket (not shown) or other means of establishing the winner as an eligible player in the subsequent grand prize raffle, to be held, perhaps, once in an evening of games. For example, several such games could be played sequentially during the evening, each with a new set of playing cards, tickets, and master game card to establish a group of players eligible to play for the grand prize. One suitable grand prize could be a car, as illustrated at 120 in FIG. 6. Other prizes, such as vacations, merchandise, or the like are also contemplated. The value of the grand prize will depend on the payout the game organizer determines to be satisfactory and on the number of games played to determine eligible players for the grand prize raffle. Additionally, state law may determine the maximum value of the grand prize and other awards in the game.

Alternatively, some of the players eligible for the grand prize raffle may be determined through other means than by playing the game of chance described herein. In one alternative embodiment, the value of the raffle prize and/or grand prize is printed on the master game card 14.

Initially, the flaps 114*a,b,c* on the master game card are in a closed position, covering the associated winning game symbol portions 112*a,b,c*, as shown in FIG. 5. The playing cards 10 are distributed and the players provided with time to open their flaps 34 and collect any free tickets 12 and open their flaps 62. Once the first round has been played, the game organizer opens the flaps 114*a,b,c* on the master game card 14 to reveal the winning raffle game symbol or symbols 112 displayed beneath or information sufficient to identify the winning game symbol(s).

Although, in the illustrated embodiment, winning raffle game symbol concealment is achieved through the use of a 2-ply master game card construction, the winning raffle game symbol cover member 114, or members, may have numerous alternative configurations. For example, master game card 14 may comprise only a single ply construction, with the winning raffle game symbol cover member 114 comprising a flap-like member affixed to master game card 14 along one or more sides of the flap-like member. Alternatively, the winning raffle game symbol cover members 114 may comprise a removable opaque substance, such as conventionally known "scratch-off" material.

In operation, the plurality of playing cards 10 are distributed to players of the present gaming system, who become holders of the playing cards 10 (it is of course contemplated that a player may give one or more of his playing cards to another person who then becomes the holder). If the present gaming system is being employed for fundraising purposes, each player will purchase one or more playing cards for the price determined by the game organizer, e.g., $1.00. The holders of the playing cards remove or open the flaps 34 to reveal the game symbols 30 displayed upon the playing card 10. Holders of cards 10 displaying free ticket symbols 40, such as three bars, three diamonds, or the like, as shown in FIG. 1, tear off the portion 54 of the card 10 displaying the symbol 40, give it to the game organizer, and receive the corresponding numbers of free tickets 12. The holders of the free tickets 12 then open their flaps 62.

The names of the holders of playing cards/tickets displaying eligible game symbols 82, which, in the illustrated embodiment, are game symbols ending in the numeric designation "13", can be recorded within the sign-up area 80 at any time throughout this period. Once all the playing cards are sold and the holders of playing cards/tickets displaying eligible game symbols 82 have been identified, the selected one of the winning game symbol cover members 100 is selectively removed or opened.

As can be appreciated, the free ticket symbols 40, eligible symbols 82, and raffle symbols 110 are optionally independent of each other, such that a holder of a playing card (or ticket) may be a winner in the first bonus round of play, a winner in the second bonus round of play, a winner in both the first and seconds bonus rounds of play, or a winner in neither of the bonus rounds. Additionally, the award of free tickets prior to the bonus rounds gives the holder of a single playing card the opportunity to have more than one chance to win an award due to the award of the additional free tickets. In one embodiment, the cards and tickets 10, 12 are configured such that no card or ticket is a winner in both the first and second rounds of play. Having symbols of two types 82, 110 allows the organizer to vary the game by awarding different payouts. For example, the organizer may decide to award a small or no award in the first round, and a much larger award or chance to win a larger grand prize award through the second round. It also allows the first and second rounds to be played in any order, e.g., at about the same time, or at different times.

While the eligible symbols 82 and 110 are described as being of separate types (i.e., the first type 82 being used only in the first bonus round and the second type 110 being used only in the second bonus round), it is also contemplated that the same symbols or groups of symbols may be used in both the first and the second bonus rounds of play. For example, the symbols 82 are optionally used in both rounds, although, as will be appreciated, only those ending in a red 13 (or other designated identifier) are eligible for the first round award. In this embodiment, the symbols 110 would be omitted from the cards and tickets. Since some of the illustrated symbols 82 have four digits and others three, it is desirable, in this embodiment, to have one of the flaps 114 covering more than one digit in cases where there are more than three digits in the winning symbol 112. Alternatively, four flaps could be provided on the master game card. This also applies in the illustrated embodiment where the separate raffle symbols 110 are used and the winning symbol 112 exceeds 999.

In one embodiment, the game organizer opens one or more, but preferably fewer than all, of the flaps 114*a*, 114*b*, and 114*c*, prior to or during sale of the playing cards 10. Thus, purchasers of playing cards and/or recipients of free tickets 12 will know, prior to opening the flaps, at least one of the winning digits 112*a*, 112*b*, 112*c*. This encourages players to purchase additional playing cards so that they have at least one playing card or free ticket showing the one or more displayed digit.

In the illustrated embodiment, the winning raffle number 112 for the raffle prize is largely predetermined, i.e., limited to one of two predetermined winners or pair of winners, in the illustrated embodiment. The identity of the winning symbol or symbols is, however, not known to the players or the game organizer until all the cover members 114 are opened. In yet another embodiment, another method of determining the raffle winner is used, which does not involve the master game card. For example, a random method of determining the raffle winner, such as drawing bingo balls, is used to determine the winning raffle symbol 112. The game organizer may announce, prior to the start of the game, what method will be used to determine the winning raffle symbol.

Figure 7:
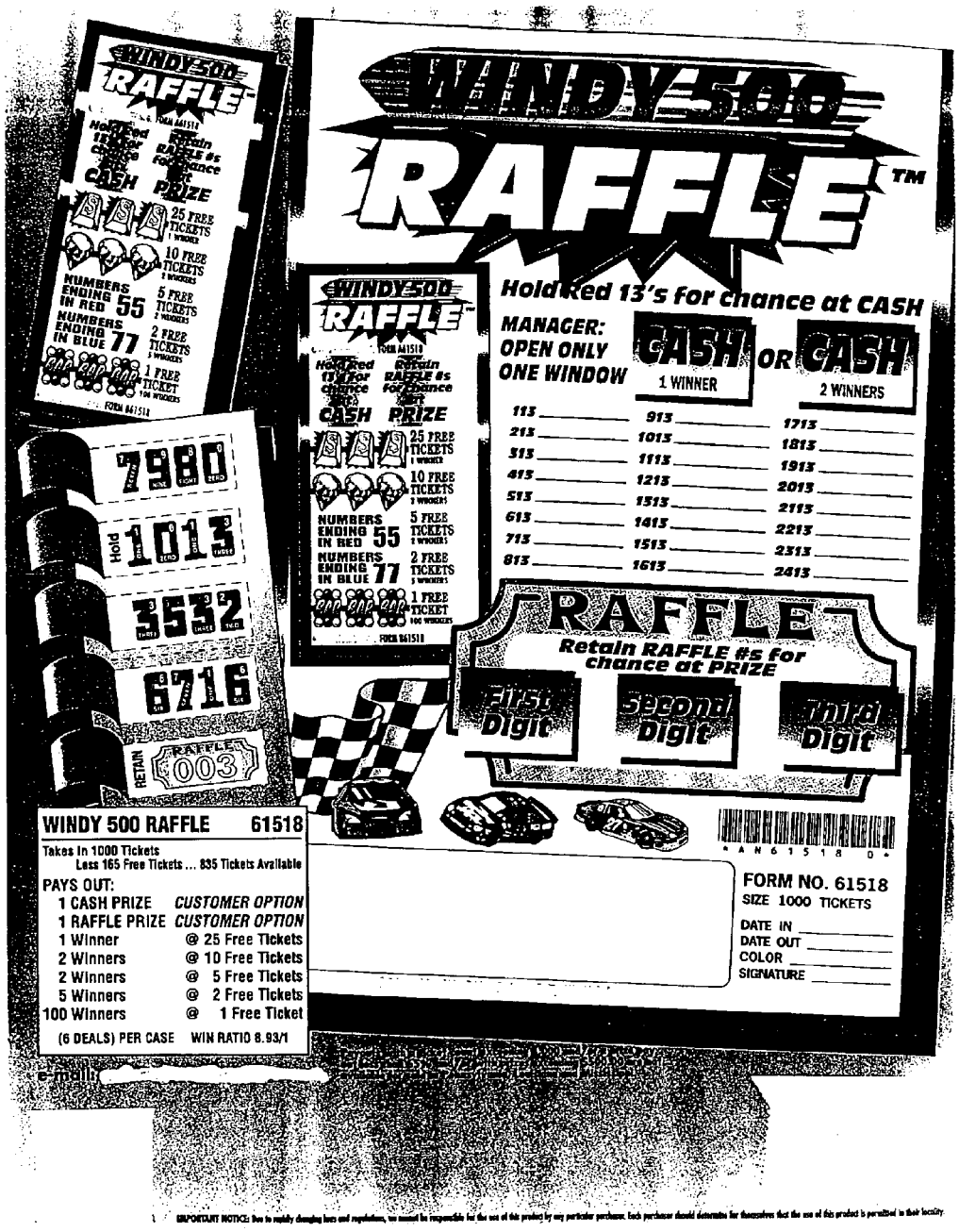
FIG. 7 is a top plan view showing a flier describing the game.

The assembled game system can include a set of playing cards 10, free tickets 12, and a master game card 14, as well as a printed set of instructions for play 130 (FIG. 7). The instructions may include information the number of tickets and free tickets and the number of tickets which are associated with an award of the free tickets. The instructions may also include information about calculating the payout, which can be determined by the organizer, based on the total selected awards for the first and second bonus rounds of play. Or, there may be a definite payout, with the profit for the game organizer displayed on the instructions.

As will be appreciated, variations of the disclosed system can be made within the purview of the present invention. As noted, the playing cards 10 and free tickets 12 can be otherwise configured, as can the master game card 14. If desired, fewer or more than the disclosed levels of play can be provided. Additionally, plural arrangements can be provided for establishing the eligibility for bonus play of selected players. For example, two listings of eligible players can be provided on the master game card, with two different criteria identified for establishing eligibility. The playing card 10 and ticket 12 are exemplary of the present invention in that the present game system includes a plurality of such playing cards/tickets such as, for example, in the illustrated embodiments, about 1000 cards and tickets in total. Each of the playing cards 10 is separately purchased by a game player, while the tickets 12 are awarded free of charge (or at a lower cost than the cards).

Although the invention has been described with reference to a master game card 14, other means for identifying the bonus round winners are also contemplated. For example, holders of playing cards displaying eligible game symbols 82 may participate in another game of chance to determine the winning eligible game symbol 94, such as by rolling a die or by employing Bingo-type balls which are used in a Bingo game.

Figure 8:
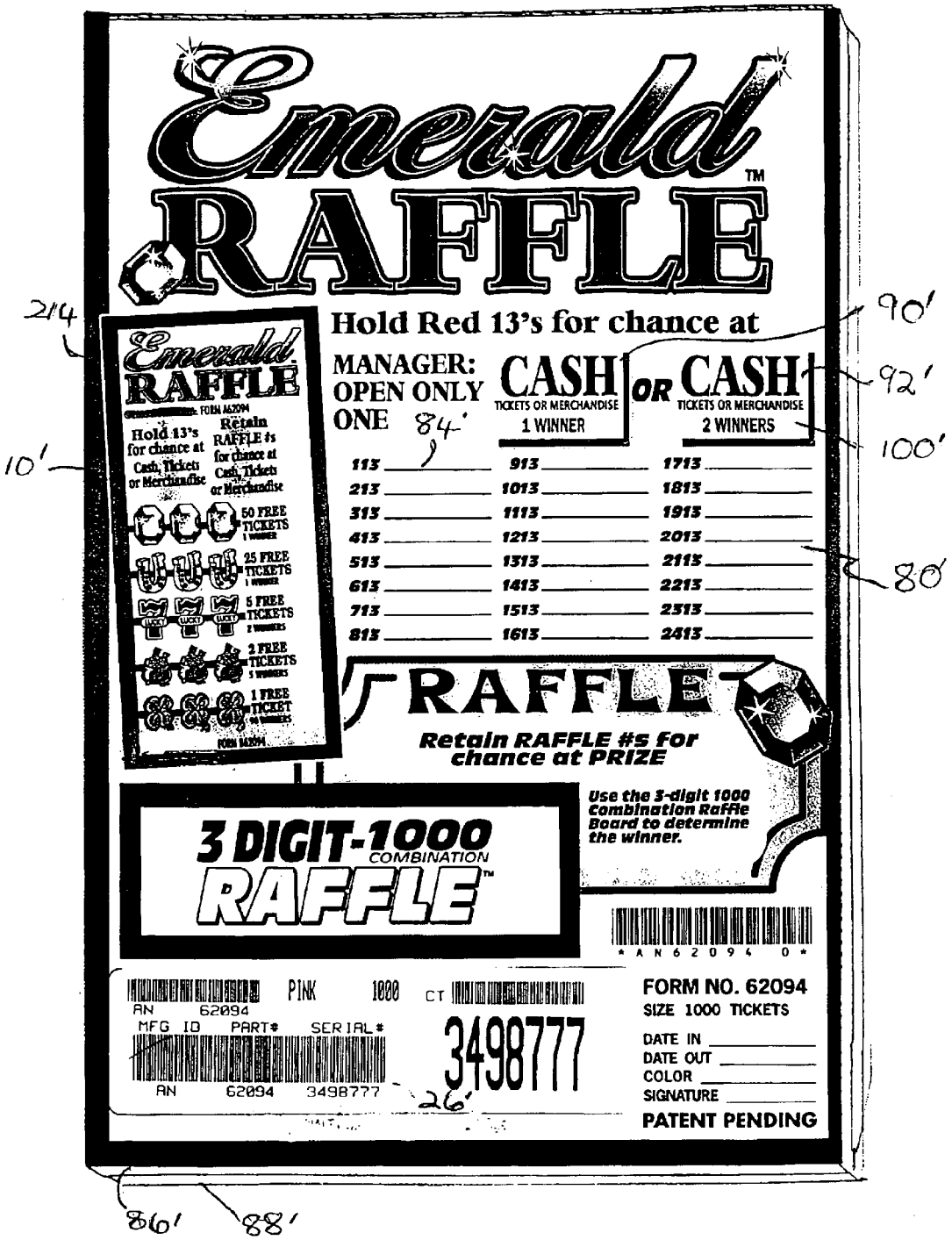
FIG. 8 is a top plan view of a master game card according to a second embodiment of the present invention.

With reference now to FIG. 8, an alternative embodiment of a master game card 214, where similar elements are numbered with a prime (') and new elements are accorded new numerals. The game is suited for use in conjunction with playing cards 10 and free tickets 12 formed as for the embodiment of FIGS. 1–7. The master game card is similar to master game card 14, except in that it does not include one or more raffle game symbols associated with the raffle prize. Rather, in this embodiment, an associated second master game card 216, which will be referred to herein as a raffle board (FIG. 9) includes an arrangement whereby a selected one (or more than one) of the playing cards or tickets is identified as a winner in the raffle round, i.e., the second bonus round of play. The first round of play is played as described above, in connection with FIGS. 5 and 6, with the master game card 214. The second round of play, which is played with the raffle board 216, may be played concurrently with or before or after the first round of play. Or, as described in greater detail below, the first round of play, associated with the master game card 214, can be omitted and thus the master game card 214 is not required.

Figure 9:
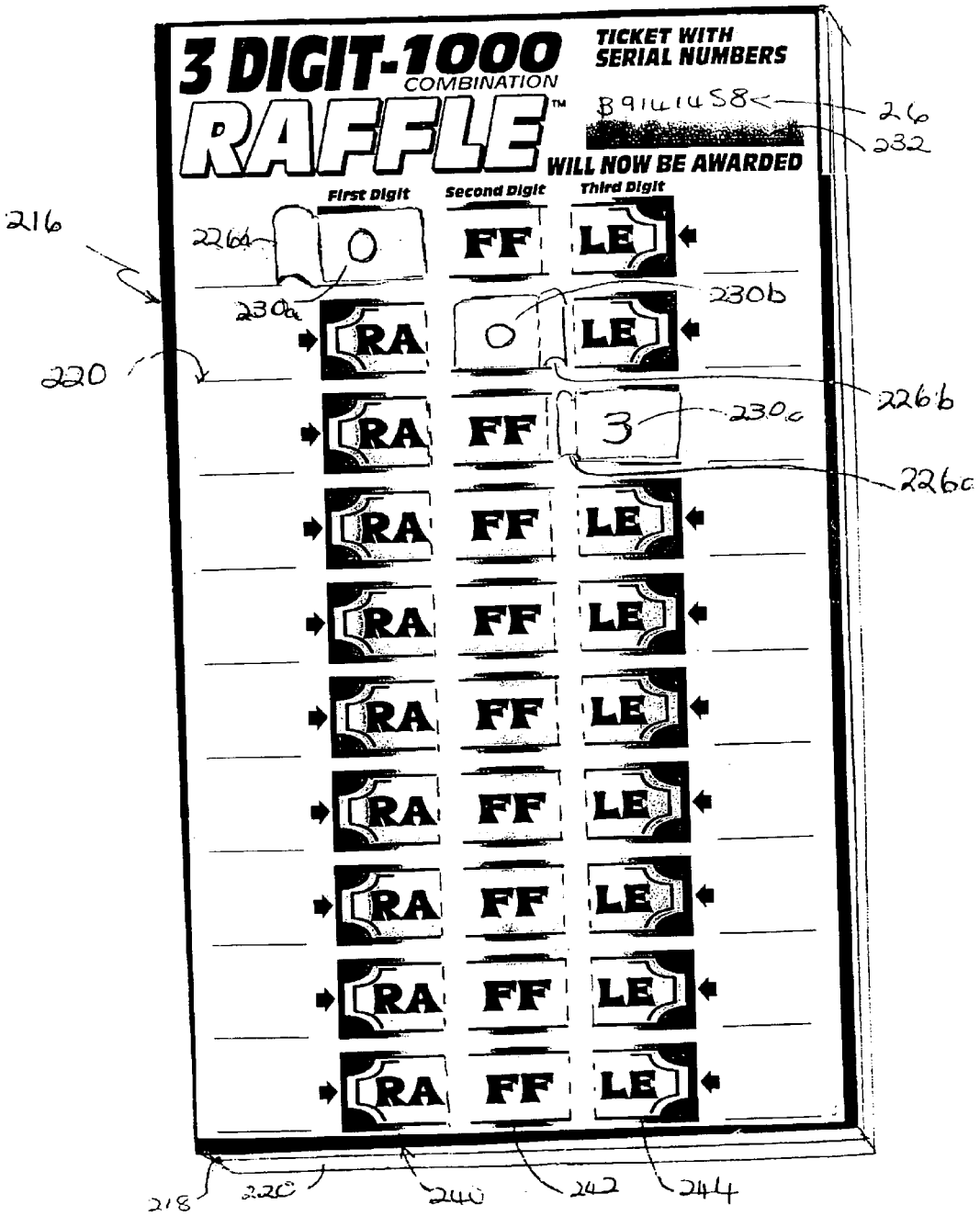
FIG. 9 is a top plan view of a raffle board for use in association with the master game card of FIG. 8.

As shown in FIG. 9, the raffle board 216 can be formed similarly to the playing cards 10 and master game card 214.

Figure 10:
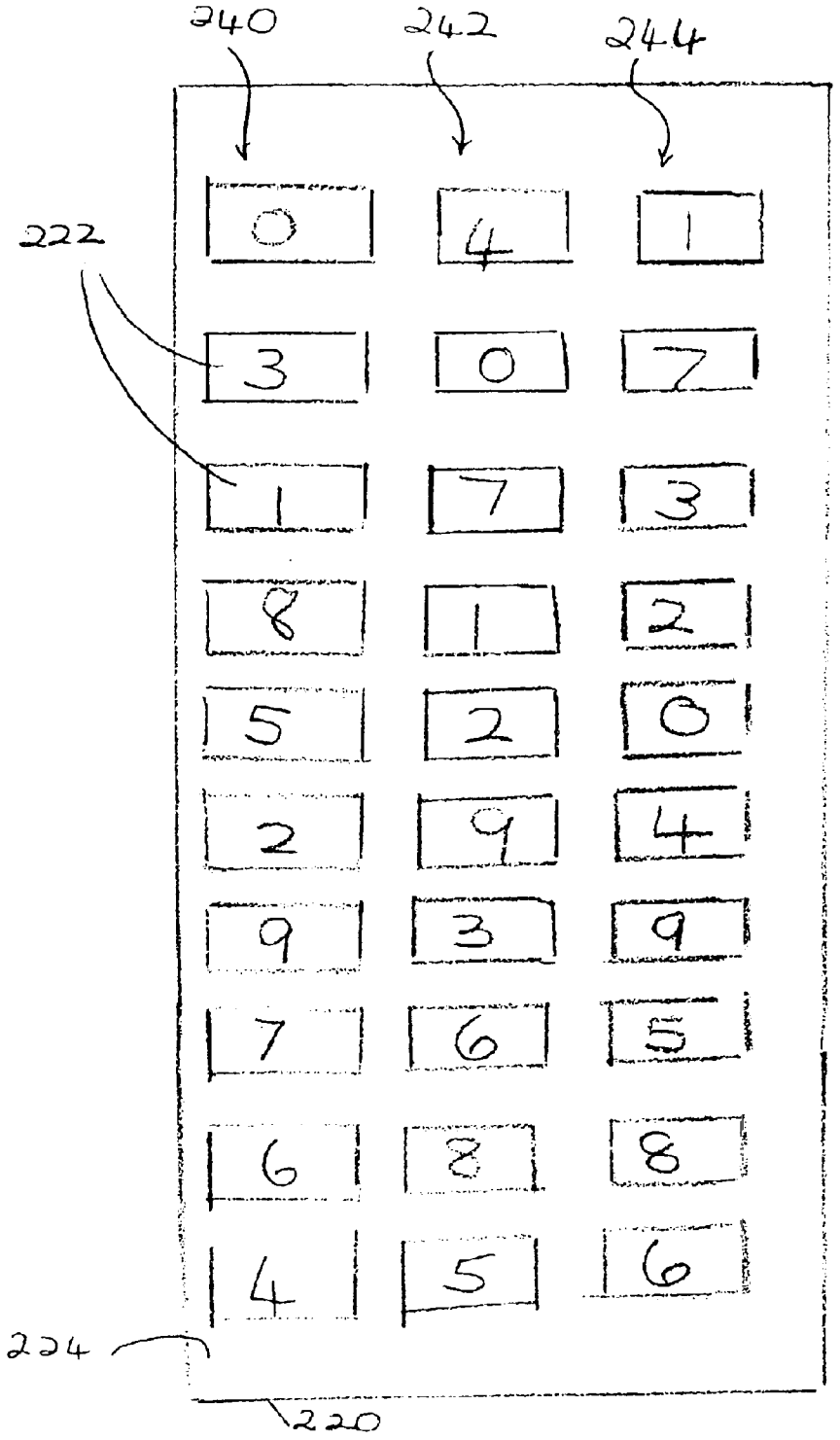
FIG. 10 is a top plan view of a bottom ply of the raffle board of FIG. 9.

For example, it may comprise a lamination of upper and lower plies of material 218, 220. The raffle board 216 is shown in FIG. 10 as including a plurality of raffle game symbols 222. In the illustrated embodiment, the raffle game symbols 222 are printed on an upper surface 224 of the lower ply 218. The raffle game symbols 222 are covered by cover members 226 (FIG. 9), such as a perforated flap similar to those on the playing cards 10, or other cover member, such as a scratch-off portion. Each flap 226 is formed in the top ply 218 of the raffle board 216 and can be pulled away to reveal a window 228 displaying the raffle game symbols 222, or a portion thereof. The game operator, or a person of his choice, opens at least one, but not all, of the flaps 226 to reveal a raffle game symbol 222 which is thereby identified as a winning raffle game symbol 230 (or a portion thereof). In this way, the winning raffle game symbol 230 is not largely predetermined, as in the embodiment of FIG. 6, since the game organizer has a free choice as to which flap (or combination of flaps in the illustrated embodiment) to open and is not furnished with the order of raffle game symbols printed beneath. Thus, in this embodiment, all of the eligible raffle symbols 110 have an equal chance of winning.

In one embodiment, several raffle boards 216 are packaged in a set, separately from the master game card 214, playing cards 10, and tickets. The game organizer selects one of the set of raffle boards. The raffle boards in the set are identical in outer appearance, thus it is even clearer to the players that the game organizer has no way of knowing what is the order of the raffle game symbols 222 on the particular raffle board selected. Where several games of the same type are being played, the game organizer may enter the serial number 26 of the particular game in a blank serial number entry area 232 on the raffle board 216 (FIG. 9) to ensure that only the player holding a winning playing card from the game corresponding to the serial number of that game is awarded the raffle prize.

As shown in FIG. 10, the raffle game symbols 222 can be arranged in three areas, such as columns 240, 242, 244. The game organizer selects only one flap 226*a*, 226*b*, 226*c*, from each of the three columns 240, 242, 244. The three flaps, when opened, each reveal a portion 230*a*, 230*b*, 230*c* of the winning raffle game symbol 230 (003 in the illustrated embodiment). As with the prior embodiment, each winning raffle game symbol 230 includes three (or more) characters, such as digits. Where digits are used, the first column 240 can represent the "hundreds", the second column 242 the "tens" and the third column 244, the "units." The opening of a first flap 226*a* reveals the first digit 230*a* (the number "0" in the illustrated embodiment) of the winning raffle game symbol 230, a second flap 226*b* reveals the second digit 230*b* (the number "0"), and a third flap 226*c* covers the third and any final digit 230*c* (the number "3"). The game organizer can open the selected flaps 226*a,b,c* in turn, e.g., sequentially. This adds to the excitement of the raffle, as each flap opened eliminates more of the eligible raffle symbols 110.

As illustrated in FIG. 10 the columns 240, 242, 244 of raffle game symbols 222 can be arranged such that the raffle numbers are not arranged in a common number order sequence (such as 0, 1, 2, 3, . . . 9 or 9, 8, 7, . . . 0). Rather, the symbols are random or otherwise out of order, as shown. Raffle boards 216 sold together can have different order sequences. In this way, until the selected flaps 226 are opened, there is no way for the game operator or players to know which of the digits 0–9 is under the selected flap.

In the illustrated embodiment, there are sufficient flaps 226, such that any one of the eligible raffle symbols 110 could be selected as a winning raffle game symbol 230 (i.e., 3 columns of ten flaps allow for all eligible raffle numbers 110 from 000 to 999). Thus, all playing cards and free tickets in the set have a chance of winning the raffle prize and the chance is equal for each of the playing cards and free tickets (1/1000 in the illustrated embodiment). However, it is also contemplated that fewer flaps may be provided, such that not all eligible raffle symbols 110 could be selected as a winning raffle game symbol 230.

It will be appreciated that the raffle board 216, rather than being separate from the master game card 214, may form a part of the master game card.

The game is played in the same manner as described above, up until the raffle level of play. Optionally, in addition to or in place of free tickets, instant win prizes may be awarded in a preliminary round of play, with a first level of the bonus round of play involving the sign up area 80' of the master game card 214 and opening of one of the flaps 100' to display the winning game symbol(s). For the raffle level of play, the master game card 214 is not required, in this embodiment. The game organizer selects a raffle board 216, and opens one flap 226 from each of the three columns 240, 242, 244 to identify first, second, and third portions of the winning raffle symbol 230. Once all three portions are revealed, the holder of the playing card 10 displaying the winning raffle symbol can claim the designated prize. Variations of the game are also contemplated, in which one or more of levels of play is omitted, or in which the order of play is changed. If the first level of play of the bonus round is omitted, the master game card is not needed, and the tickets can be printed without the eligible game symbols 82.

Figure 11:
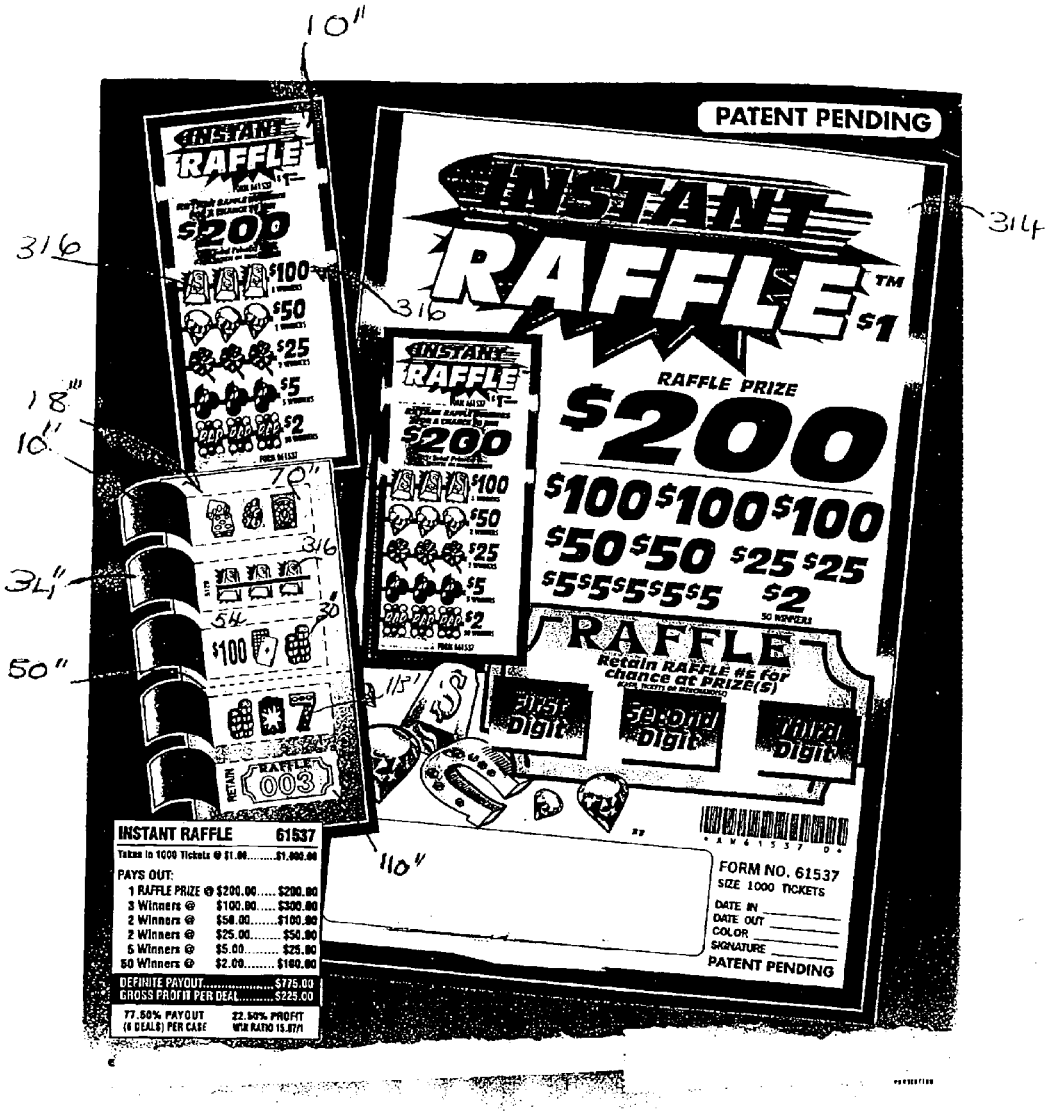
FIG. 11 is a top plan view of a flier showing a master game card and top and bottom surfaces of a playing card according to a third embodiment of the present invention.

With reference now to FIG. 11, another embodiment of a master game card 314 is shown. The master game card 314 is similar to master game card 14, except as noted. Similar elements are numbered with a double primed suffix (") and new elements are accorded new numerals. In this embodiment, the sign up area 80, award identifiers 90, 92, and associated winning game symbol or symbols 94 are omitted. The first type of eligible game symbols 82 can also be omitted from the playing cards 10", as illustrated in FIG. 11.

In this embodiment, in place of free tickets 12, some of the playing cards 10" include a third type of game symbol 316, referred to as instant win symbols, which entitle the holder of a playing card displaying one of the instant win symbols to collect a corresponding award 318, which is described on the front face of the playing card. In the illustrated embodiment, an award of $100 is awarded to the holder of a playing card 10" displaying three gold bars, and so forth. The player submits the portion 54 of the playing card displaying the instant win symbols 316 and is awarded the associated prize. The remaining portion 52 of the playing card 10" is held, as before, for use in the bonus round. Play then proceeds as for the master game card 14, but without the first bonus level of play, i.e., with a single bonus round for awarding of a raffle prize similar to the second bonus round of the embodiment of FIGS. 1–7.

It will be appreciated that the playing cards 10" used in conjunction with the master game card 314 can alternatively be the same as playing cards 10, illustrated in FIGS. 3 and 4. Optionally, free tickets are awarded in place of monetary awards.

Playing cards 10 and 10" are similarly suited to playing a game with the raffle board 216 in which the first bonus level of play is omitted and only instant win prizes (or free ticket awards) and raffle prize(s) are awarded.

Figure 12:
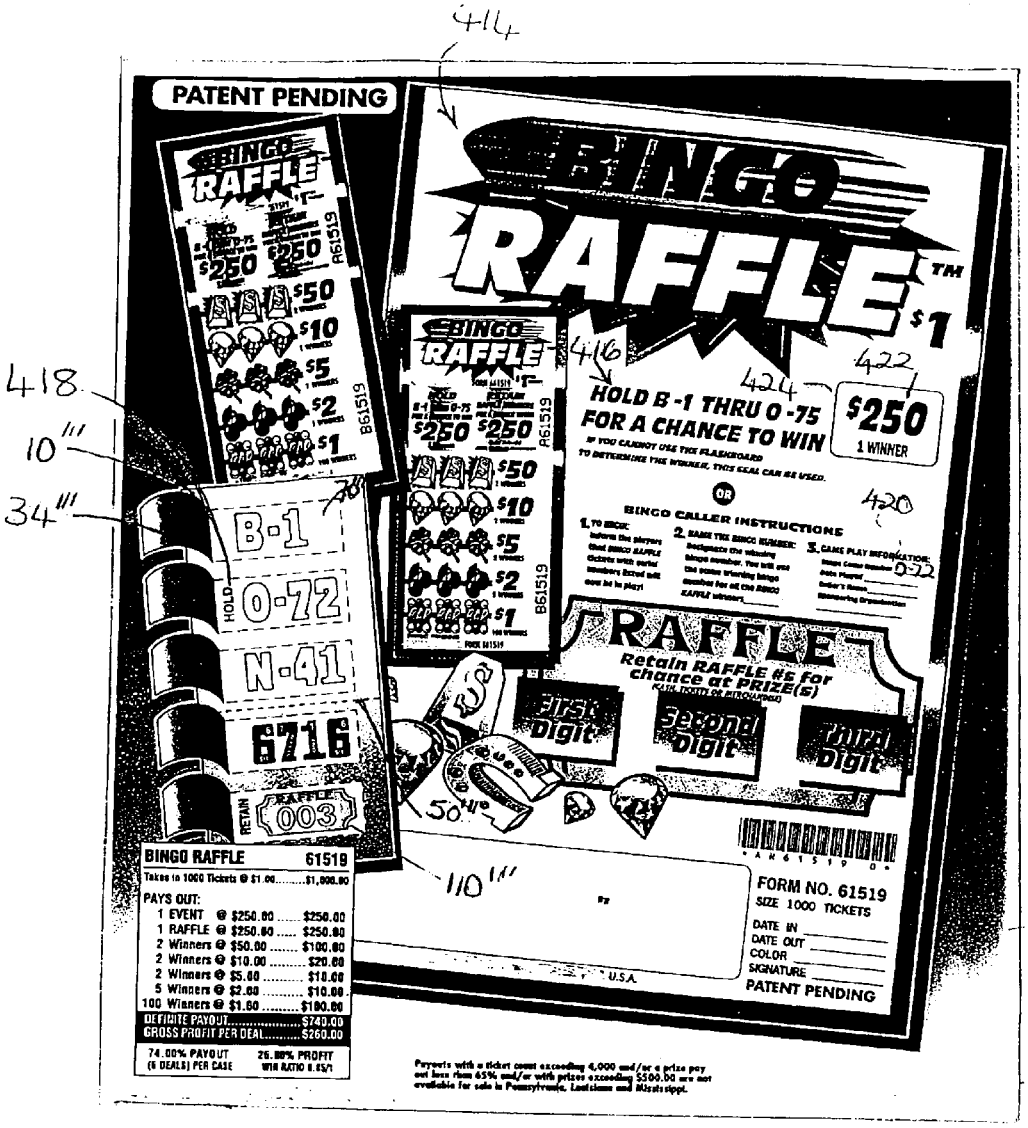
FIG. 12 is a top plan view of a flier showing a master game card and top and bottom surfaces of a playing card according to a fourth embodiment of the present invention.

With reference to FIG. 12, another embodiment of a master game card and playing card are shown, where similar elements are numbered with a triple primed suffix (''') and new elements are accorded new numerals. A master game card 414 is similar to master game card 314, in that a sign up area, award identifiers, and associated winning game symbol or symbols are omitted. Instead, it further includes an area 416 for use in designating one of a fourth type of eligible game symbols 418, such as BINGO-style numbers, as a winning game symbol 420. The fourth type of eligible game symbols 418 will be referred to as Bingo numbers, although it will be appreciated that other symbols may alternatively be used. The Bingo numbers are displayed on playing cards 10''' in a similar manner to that described above for other game symbols. In the illustrated embodiment, the word HOLD is used to signify that the associated Bingo number 418 is to be used in a first bonus round of play. Playing cards 10''' are otherwise similar to playing cards 10'' in that some of the playing cards include instant win game symbols 316'''. The various game symbols can be covered, prior to play, with a cover member or members 34'''. Optionally, all playing cards 10''' in the set display one of the Bingo numbers 418, although it is also contemplated that less than all of the playing cards could display one of the Bingo numbers.

The winning game symbol 420 can be selected from the eligible game symbols by a manner separate from the playing cards 10''' and master game card 414, for example by drawing bingo balls or by another type of automated random number generator (not shown). Optionally, in the event that a random number generator is not available, the area 416 may include an award identifier or identifiers 422 on a cover member 424, which is opened to reveal an associated winning game symbol (not shown) similar to award identifier 90, 92, and associated winning game symbol or symbols 94 of FIG. 5.

Thus, what has been disclosed is a "lottery-type" game of chance for a plurality of players which employs break open playing cards (10, 10', 10'', 10'''). Optionally, at least some of the playing cards have free ticket symbols (40) that entitle the holder to receive at least one free ticket (12). Some of the playing cards and tickets include eligible game symbols (82, 110), which entitle the playing card/ticket holder to enter a bonus round or rounds of play. A separate master game card (14, 214, 216, 314, 414) is used to identify the winner of the bonus round or rounds. In one embodiment, portions (112*a, b,c*) of a winning symbol (112) on the master game card are uncovered sequentially in a raffle round of play. In another embodiment, the game organizer opens selected cover members (226*a,b,c*), each corresponding to a portion (230*a,b,c*) of a winning game symbol (230). Optionally, the holder of a playing card/ticket displaying a winning symbol (112, 230) is entitled to enter a subsequent bonus round for a grand prize, in which similar holders from other games are also eligible to participate. The game may include awards in separate rounds, such as instant win awards, randomly drawn awards, and/or awards to predetermined winners. Unlike the raffle round, only certain ones of the tickets and/or playing cards may display eligible symbols which entitle the holders to participate in these separate rounds. The purchaser of a playing card (10) thus has several potential ways to become a winner and can be assured of at least a chance of winning the raffle prize.

The invention has been described with reference to the preferred embodiments. Obviously, alterations and modifications will occur to others upon a reading and understanding of this specification. It is intended that the invention be construed as including all such modifications and alterations as fall within the scope of the appended claims or the equivalents thereof.

I claim:

1. A system for use in playing a game of chance comprising:

a plurality of playing cards, at least some of said plurality of playing cards displaying a free ticket symbol which entitles a holder of the playing card to receive at least one free ticket, at least some of said free tickets displaying at least one game symbol;

a plurality of said free tickets, each of said free tickets displaying at least one game symbol, at least some of said playing cards and at least some of said free tickets including at least one eligible game symbol selected from said game symbols displayed thereon; and a master game card for use in conjunction with said playing cards and free tickets, said master game card including means for identifying at least one of said eligible game symbols as a winning game symbol.

2. The system of claim 1, wherein a first plurality of said eligible game symbols comprise eligible raffle game symbols, and wherein at least one of said master game card and a second master game card includes means for identifying at least one of the eligible raffle game symbols as a winning raffle game symbol.

3. The system of claim 2, further comprising at least one obscuring member for the means for identifying.

4. The system of claim 2, wherein the at least one obscuring member covers a portion of the winning raffle game symbol.

5. The system of claim 3, wherein a plurality of obscuring members each cover a portion of an eligible raffle game symbol, the winning raffle game symbol being identified by opening selected ones of the obscuring members, such that the winning game symbol is not determined until the selected obscuring members are removed.

6. The system of claim 3, wherein the obscuring members include flaps.

7. The system of claim 2, wherein the master game card further includes means for identifying at least one of a second plurality of said eligible game symbols as a winning game symbol.

8. The system of claim 7, wherein the means for identifying at least one of the second plurality of eligible game symbols includes at least one cover member which is opened to reveal the winning game symbol.

9. The system of claim 1, wherein at least one game symbol of at least one of said playing cards and free tickets comprises indicia identifying the game symbol as being an instant winning game symbol.

10. A system for playing a game of chance comprising:

a plurality of playing cards, at least some of said plurality of playing cards including at least one of a plurality of eligible game symbols displayed thereon; and a raffle board for use in conjunction with said playing cards, said raffle board including:

means for identifying at least one of a first plurality of said eligible game symbols as a winning raffle game symbol, including:

a first plurality of cover members, each of the first plurality of cover members selectively covering a first portion of a raffle game symbol, and a second plurality of cover members, each of the second plurality of cover members selectively covering a second portion of a raffle game symbol, whereby by uncovering a selected one of the first plurality of cover members and a selected one of the second plurality of cover members, first and second portions of the same winning raffle game symbol are revealed.

11. The system of claim 10, wherein the raffle board further includes:

a third plurality of cover members, each of the third plurality of cover members selectively covering a third portion of a raffle game symbol, whereby by uncovering a selected one of the third plurality of cover members in addition to one of the first and second pluralities of cover members, a third portion of the same winning raffle game symbol is revealed.

12. The system of claim 10, wherein a plurality of the playing cards display a free ticket symbol which entitles a holder of the playing card to receive at least one free ticket, the system further including:

a plurality of said free tickets, each of said free tickets displaying at least one game symbol, at least some of said free tickets including at least one of the said first plurality of eligible game symbols displayed thereon.

13. The system of claim 10, wherein each of said playing cards includes one of said first plurality of said eligible game symbols displayed thereon.

14. The system of claim 10, further including:

a master game card for use in conjunction with said playing cards, said master game card including means for identifying at least one of a second plurality of said eligible game symbols as a winning game symbol.

15. The system of claim 10, wherein the playing cards further include a cover member for initially concealing said at least one game symbol displayed thereon.

16. The system of claim 15, wherein the game symbol cover member includes a flap.

17. The system of claim 10, wherein at least one game symbol of at least one of said playing cards comprises indicia identifying the game symbol as being an instant winning game symbol.

18. The system of claim 10, wherein a plurality of said playing cards each displays one of a third plurality of game symbols configured for use in a bonus round of play in which a winning game symbol of the third plurality of game symbols is drawn randomly.

19. A method of playing a game of chance comprising:

distributing a set of playing cards to a plurality of players;

removing at least one cover member on each of the playing cards to reveal at least one of a plurality of game symbols, at least some of said plurality of playing cards including a free ticket symbol, which entitles a holder of the playing card to receive at least one free ticket;

distributing the free tickets to the holders of playing cards displaying the free ticket symbols;

removing at least one cover member from said free tickets, wherein at least one of said playing cards and said free tickets includes an eligible first type of game symbol of said plurality of game symbols, which is eligible for a first bonus round of play, and wherein at least one of said playing cards and said free tickets includes an eligible second type of game symbol of said plurality of game symbols, which is eligible for a second bonus round of play;

playing the first bonus round of play; and playing the second bonus round of play.

20. The method of claim 19, wherein the step of playing the first bonus round of play includes:

uncovering at least a first winning game symbol selected from said eligible game symbols associated with at least a first bonus award, a holder of a playing card or free ticket displaying the winning game symbol receiving the first bonus award.

21. The method of claim 20, wherein the second bonus round of play includes:

uncovering a second winning game symbol selected from said eligible second type of game symbols, a holder of the playing card or free ticket displaying the second winning game symbol being eligible to enter into a third round of play in which players in other games of chance also participate.

22. A method of playing a game of chance comprising:

distributing a set of playing cards to a plurality of players;

removing at least one cover member on each of the playing cards to reveal at least one of a plurality of game symbols, at least some of said plurality of playing cards including a free ticket symbol, which entitles a holder of the playing card to receive at least one free ticket;

distributing the tree tickets to the holders of playing cards displaying the free ticket symbols;

removing at least one cover member from said free tickets, wherein at least one of said playing cards and said free tickets includes an eligible first type of game symbol of said plurality of game symbols which is eligible for a bonus round of play; the eligible first type of game symbols including a plurality of characters;

playing the bonus round of play, including:

a) opening a cover member on a master game card to reveal one, but not all, of the plurality of characters in a winning game symbol selected from the second type of eligible game symbols; and b) repeating step a) for each of the plurality of characters in the same winning game symbol, whereby the wining game symbol is revealed.

23. The method of claim 22, further including:

playing a second bonus round of play, which includes one of the following steps:

opening a cover member on a master game card to reveal one of an eligible second type of game symbols as a winning game symbol; and randomly drawing one of the eligible second type of game symbols as a winning game symbol.

24. The method of claim 23, wherein each of the playing cards and free tickets displays one of said second type of eligible game symbols.

25. The method of claim 22, wherein the master game card includes a plurality of cover members covering characters of the first type of eligible game symbols, whereby each of the first type of eligible game symbols is represented and has a chance of being selected as the winning game symbol.

26. A method of playing a game of chance comprising:

distributing a set of playing cards to a plurality of players;

removing at least one cover member on each of the playing cards to reveal at least one of a plurality of game symbols, a plurality of the playing cards including a raffle game symbol of said plurality of game symbols which is eligible for a bonus round of play comprising a raffle;

in the bonus round of play, in a first step, revealing only a first portion of a winning raffle game symbol on a first area of a master game card and in a second step, revealing only a second portion of the same winning raffle game symbol on a second area of the master game card.

27. The method of claim 26, wherein the bonus round further includes:

revealing a third portion of the winning raffle game symbol on a third area of a master game card.

28. The method of claim 26, wherein the raffle game symbols each comprise a plurality of digits and the first and second portions of the winning game symbols each comprises one of the digits, the bonus round further including:

uncovering a separate cover member for each of the digits of the winning raffle game symbol on separate areas of a master game card.

29. The method of claim 26, wherein the steps of revealing the first and second portion of the winning raffle game symbol, and optionally a third portion of the winning raffle game symbol include:

removing one of a plurality of cover members in the first area to reveal the first portion of the winning raffle game symbol;

removing one of a plurality of cover members in the second area to reveal the second portion of the winning raffle game symbol; and optionally, removing one of a plurality of cover members in the third area to reveal the third portion of the winning raffle game symbol.

30. The method of claim 29, wherein the cover members in the first second and third areas form columns.

31. The method of claim 26, wherein every one of the tickets in the set displays a raffle game symbol.

32. The method of claim 26, further including awarding a prize to a holder of a ticket having a raffle symbol which corresponds to the winning raffle symbol.

33. The method of claim 26, wherein a plurality of the playing cards display an eligible game symbol which entitles the holder to enter a second round of play on the master game card or a second master game card, and the method further includes:

opening a cover member on the master game card or second master game card to reveal a winning game symbol selected from the eligible game symbols.

* * * * *